US007581973B2

(12) United States Patent
Fukazawa

(10) Patent No.: US 7,581,973 B2
(45) Date of Patent: Sep. 1, 2009

(54) CAM STRUCTURE AND CONNECTOR USING THE SAME

(75) Inventor: Takeki Fukazawa, Koto-ku (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/616,595

(22) Filed: Dec. 27, 2006

(65) Prior Publication Data

US 2007/0175741 A1 Aug. 2, 2007

(30) Foreign Application Priority Data

Dec. 27, 2005 (JP) ..... 2005-373782

(51) Int. Cl.
*H01R 13/62* (2006.01)
*H01R 13/15* (2006.01)

(52) U.S. Cl. ..... 439/260; 439/495

(58) Field of Classification Search ..... 439/260, 439/495, 267

See application file for complete search history.

(56) References Cited

U.S. PATENT DOCUMENTS 5,695,360 A * 12/1997 Seto et al. ..... 439/495
7,147,498 B1 * 12/2006 Gillespie et al. ..... 439/260
7,172,446 B1 * 2/2007 Hashimoto et al. ..... 439/260

FOREIGN PATENT DOCUMENTS

| | | |
|---|---|---|
| JP | H06-82783 | 3/1994 |
| JP | 10-214661 | 8/1998 |
| JP | H11-307198 | 1/1999 |
| JP | 2003-422258 | 3/2003 |
| JP | 2003-297489 | 10/2003 |
| JP | 2004-71160 | 3/2004 |
| JP | 2004-221067 | 8/2004 |
| JP | 2004-307793 | 11/2004 |
| JP | 2005-178666 | 7/2005 |
| JP | 2006-147523 | 6/2006 |
| JP | 2006-351453 | 12/2006 |

* cited by examiner

*Primary Examiner*—Javaid Nasri
(74) *Attorney, Agent, or Firm*—Baker Botts LLP

(57) ABSTRACT

A cam structure is pivotally moving between electronic parts to act on the other parts, which enables the action on the other parts upon pivotal movement to be varied by partly modifying a cam shape of the cam structure. For example, when the cam structure is pivotally moved in a connector to bring contacts into contact with a connecting object inserted in the connector, contact pressure of the contacts is controlled by partly modifying the cam shape of the cam structure. The cam structure has advantages that its cam portion can be pivotally moved by a slight force without requiring any large force and being capable of shifting the timing at which the cam contacts the mating parts depending upon customers specifications.

5 Claims, 8 Drawing Sheets

CAM STRUCTURE AND CONNECTOR USING THE SAME

CROSS-REFERENCE TO RELATED APPLICATIONS

This application claims priority from Japanese Patent Application No. 2005-373,782, filed Dec. 27, 2005, which is herein incorporated by reference in its entirety.

BACKGROUND OF THE INVENTION

This invention relates to a cam structure for use in electric and electronic appliances and being capable of varying forces and actions to be applied to a mating object by modifying its cam shape, and more particularly to a connector using such a cam structure.

In the art of mechanical structures, it has long been used to vary a cam shape as a cam mechanism to change the timing of action caused by the cam mechanism. In the art of electric and electronic appliances, however, aside from miniaturization of such appliances, it have not been performed to vary a cam shape for changing the timing.

In general, connectors for use in, for example, mobile phones, charge coupled device (CCD) cameras and the like are much thinner and having contacts arranged in extremely narrow pitches (so-called lighter and more compact connectors). These connectors each mainly comprise a housing, contacts and a pivoting member so that after a flexible printed circuit board has been inserted into the housing, the pivoting member is rotated on a fitting side or opposite side thereto, thereby bringing contact portions of the contacts into contact with the flexible printed circuit board. The housing is provided with a required number of inserting holes for inserting the contacts and also a fitting opening into which the flexible printed circuit board is inserted. The contacts each mainly comprise a contact portion adapted to contact the circuit board, a connection portion to be connected to a substrate or the like, and a fixed portion to be fixed to the housing. The contacts are fixed to the housing by means of press-fitting or the like.

By way of example, described hereafter are Patent Literature 1 (Japanese Patent Application Opened No. 2003-297,489) as an example of a connector of zero-insertion force (ZIF) type, a so-called "back-lock type", Patent Literature 2 (Japanese Patent Application Opened No. H11-307,198/1999), and Patent Literature 3 (Japanese Patent Application Opened No. 2004-71,160) proposed by the applicant of the present application. Moreover, described as examples of locking structures for a flexible printed circuit board are Patent Literature 4 (Japanese Utility Model Application Opened No. H6-82,783/1994), Patent Literature 5 (Japanese Patent Application No. 2003-422,258) proposed by the applicant of the present application, Patent Literature 6 (Japanese Patent Application No. 2004-307,793), and Patent Literature 7 (Japanese Patent Application No. 2005-178,666).

Patent Literature 1

According to the Abstract of the Japanese Patent Application Opened No. 2003-297,489, the invention has an object to provide a connector having a reduced overall height including an actuator to be operated by a slight actuating force and enabling contacts to move large distances to ensure reliable connection of the contacts. In the disclosed connector, the actuator includes a cam portion and an actuating portion and is formed between the cam portion and the actuating portion with relief grooves into and from which the forward ends of spring portions of the contacts are inserted and removed. The actuator is rotated clockwise about a fulcrum so that the cam portion causes the spring portions and jointing spring portions of the contacts to be elastically deformed to embrace a flexible printed circuit board between projections of contact portions of the contacts, with the result that patterns of the circuit board are connected through terminal portions of the respective contacts to a printed substrate. An insulator includes a ceiling portion for covering the contact portions of the respective contacts and a guide portion formed forwardly of and below the ceiling portion for guiding the flexible printed circuit board being inserted into the connector.

Patent Literature 2

According to the Abstract of the Japanese Patent Application Opened No. H11-307,198 (1999), the invention has an object to provide a connector for a printed circuit board, connecting a plurality of terminals and holding the flexible printed circuit board, which achieves improved operationality and holding performance. The disclosed connector includes a housing having an inserting groove for inserting a flexible printed circuit board or the like, a plurality of contacts arranged side by side so as to permit their contact portions to extend into and retract from the inserting groove, and an actuating member having a plurality of cams and being pivotally movable between a connecting position and a release position. When the actuating member is in the connecting position, operated portions of the contacts are urged by the cams to cause the contact portions to extend into the inserting groove so that the contact portions are pressed against terminals of the flexible printed circuit board or the like, thereby electrically connecting the terminals to the contacts and holding the circuit board or the like. When the actuating member is in the release position, operated portions of some contacts are urged by the cams to cause the contact portions to slightly extend into the inserting groove so that the contact portions abut against the flexible printed circuit board to temporarily hold the circuit board, and the contact portions of the remaining contacts are caused to retract relative to the inserting groove.

Patent Literature 3

According to the Abstract of the Japanese Patent Application Opened No. 2004-71,160, the invention has an object to provide a connector being capable of securely pressing a flexible printed circuit board or flexible flat cable against contact portions of contacts by means of a slider without degrading strengths and specifications of respective components, and being superior in operationality, and achieving narrow pitches of conductors and reduced overall height of the connector. Disclosed is the connector whose contacts each comprise a contact portion, and a connection portion, and further an elastic portion and a fulcrum between the contact portion and the connection portion, and the contact portion, the elastic portion, the fulcrum and the connection portion are arranged substantially in the form of a crank. Further, the contacts are each provided with a pressure receiving portion extending from the elastic portion at a location facing to the connection portion. The slider is provided with urging portions continuously arranged side by side in a row in its longitudinal direction, and is mounted on a housing so as to permit the urging portions to be pivotally moved between the connection portions and pressure receiving portions of the contacts.

Patent Literature 4

According to the Abstract of the Japanese Utility Model Application Opened No. H6-82,783 (1994), the utility model has an object to provide a connector being capable of easily anchoring by pawls of a slider a flexible flat cable even having a rigid reinforcement plate attached to its rear face. Disclosed is a connector construction comprising a housing including contact pins therein and formed with a fitting space into which a flat cable is inserted, and a slider mounted on the housing so that the slider can be detachably inserted into the fitting space of the housing and is pivotally movable outside of the housing upon removal, thereby bringing the flat cable into electrical contact with the contact pins by forcing the slider into the fitting space after the flat cable has been inserted into said fitting space, wherein said slider is provided with on its flat cable abutting surface with anchoring protrusions adapted to be inserted into and anchored in anchoring portions formed in the flexible cables and formed in a reinforcement plate attached to the rear face of the flexible cable.

Patent Literature 5

In Japanese Patent Application No. 2003-422,258 proposed by the applicant of the present application as a construction for locking a flexible printed circuit board, the invention has an object to provide a connector ensuring a required holding force for a flexible printed circuit board, even if the number of conductors is small, without causing any defective connection. According to this invention, the connector to be detachably fitted with a flexible printed circuit board includes a required number of contacts each having a contact portion adapted to contact a flexible printed circuit board, and a housing holding and fixing the contacts therein and having a fitting opening into which the flexible printed circuit board is inserted, wherein the flexible printed circuit board is provided with anchoring portions and a locking member having engaging portions adapted to engage the anchoring portions is mounted on the housing so that the flexible printed circuit board is fixed so as not to be removed from the housing by causing the engaging portions of the locking member to be engaged with the anchoring portions of the printed circuit board, and a further reliable locking can be achieved by providing grooves in positions corresponding to the engaging portions.

Patent Literature 6

In the Abstract of Japanese Patent Application No. 2004-307,793 proposed by the applicant of the present application in order to improve dust-proof property, the invention has an object to provide a connector with high dust-proofing capability and requiring little or no insertion force for a flexible printed circuit board. The connector includes a required number of contacts, a housing, and a pivoting member, wherein the contacts each comprise at least a contact portion, a connection portion, a fulcrum portion, a jointing portion and a pressure receiving portion, and are substantially H-shaped, and when urging portions of the pivoting member are pivotally moved between the connection portions and the pressure receiving portions to bring the contact portions into contact with a connecting object, and wherein the housing comprises a ceiling portion for covering the contact portions of the contacts and an upper wall for covering the pressure receiving portions of the contacts, and the pivoting member comprises an actuating portion, the urging portions, anchoring holes, and a cover portion which covers the tail portions of the contacts after the pivoting member has been pivoted.

Patent Literature 7

According to the Abstract of Japanese Patent Application No. 2005-178,666, proposed by the applicant of the present application for the purpose of improving dust-proofing, the invention has an object to provide a connector improved in dust-proofing and achieving no insertion force for flexible printed circuit board. A connector includes a required number of contacts, a housing, and a pivoting member, wherein the contacts each at least having a contact portion, a connection portion, a fulcrum portion, a jointing portion, and a pressure receiving portion, these portions being arranged substantially in the form of an H-shape, and the pivoting member is so constructed that upon pivotal movement of urging portions of the pivoting member between the connection portions and the pressure receiving portions of the contacts, the contact portions are brought into contact with a connecting object, and wherein the housing has a ceiling portion for covering the contact portions of the contacts and an upper wall for covering the pressure receiving portions of the contacts, and the pivoting member has an actuating portion, urging portions, anchoring holes, and a cover portion so that upon pivotal movement of the pivoting member, gaps between the tip of the upper wall and the actuating portion and between the upper wall and the tip of the pivoting member opposite from the side of the actuating portion of the pivoting member are made as narrow as possible within a range which does not allow the pivotally moving pivoting member to touch the upper wall of the housing.

In the art of the connectors also, constructions have been increasingly used, whose contacts are brought into contact with a connecting object such as a flexible printed circuit board and the like by utilizing a cam structure as in the Patent Structure 1 to 7. In the connectors having the comparatively large numbers of conductors of the Patent Literatures 1 to 7, there are ones having more of eighty conductors. In order to bring more of eighty contacts into contact with a flexible printed circuit board by rotating a cam at a time, a comparatively great force in excess of approximately 90N would be needed. On the other hand, connectors have been miniaturized so that parts to be operated for rotating the cam have also been miniaturized, which makes it impossible to rotate the cam manually.

SUMMARY OF THE INVENTION

In view of the problems of the prior art described above, the invention has an object to provide a cam structure allowing its cam portion to be rotated without requiring any large force and being capable of shifting the timing at which the cam contacts mating parts depending upon customer's specifications.

The above object can be achieved by the cam structure pivotally moving between electronic parts to act on the other parts, which enables the action on the other parts upon pivotal movement to be varied by partly modifying a cam shape of the cam structure.

In the cam structure pivotally moving in a connector 10 to bring contacts 14 and 16 into contact with a connecting object inserted in the connector 10, contact pressure of said contacts 14 and 16 can be controlled by partly modifying a cam shape of said cam structure.

In the connector 10 detachably fitting with a connecting object, including a required number of contacts 14 and 16 each having a contact portion 26 adapted to contact said connecting object, a housing 12 holding and fixing said contacts 14 and 16 therein and having a fitting opening 20 for inserting said connecting object thereinto, and a pivoting member 18 having a cam portion 54 which urges said contacts 14 and 16, said contact 14 and 16 each have at one end the contact portion 26 adapted to contact said connecting object and at the other end a pressure receiving portion 32 adapted to be urged by said cam portion 54 of said pivoting member 18, and said pivoting member 18 is pivotally mounted on said housing 12 so as to urge the pressure receiving portions 32 of said contacts 14 and 16 upon pivotal movement of said pivoting member 18, while contact pressure of said contacts 14 and 16 against said connecting object is controlled by partly modifying a cam shape of said cam portion 54.

In the connector 10 said contacts 14 and 16 each comprise a first piece 22 including at one end the contact portion 26 adapted to contact said connecting object and at the other end the pressure receiving portion 32 to be urged by the cam portion 54 of said pivoting member 18, a second piece 24 including at one end an extension portion 36 having a further contact portion 26 or a fixed portion 38 and at the other end a connection portion 40 to be connected to a substrate, and a jointing fulcrum 30 for connecting said first and second pieces 22, 24, and said housing 12 having a ceiling portion 50 for covering the contact portions 26 of said contacts 14 and 16, while said pivoting member 18 comprises an actuating portion 56 for pivotally moving the pivoting member 18, the cam portion 54 having longitudinally continuous cam parts, and anchoring holes 58 provided independently from one another into which said pressure receiving portions 32 can be inserted, said pivoting member 18 being pivotally mounted on said housing 12 so that said cam portion 54 is pivotally movable between the connection portions 40 and the pressure receiving portions 32 of said contacts 14 and 16.

In the connector said contacts 14 and 16 each comprise a first piece 22 including at one end the contact portion 26 adapted to contact said connecting object and at the other end the pressure receiving portion 32 to be urged by the cam portion 54 of said pivoting member 18, a second piece 24 including at one end a connection portion 40 to be connected to a substrate and at the other end an extension portion 36, and a jointing fulcrum 30 for connecting said first and second pieces 22, 24, and said housing 12 having a ceiling portion 50 for covering the contact portions 26 of said contacts 14 and 16, while said pivoting member 18 comprises an actuating portion 56 for pivotally moving the pivoting member, the cam portion 54 having longitudinally continuous cam parts, and anchoring holes 58 provided independently from one another into which said pressure receiving portions 32 can be inserted, said pivoting member 18 being pivotally mounted on said housing 12 so that said cam portion 54 is pivotally movable between the connection portions 40 and the pressure receiving portions 32 of said contacts 14 and 16.

In the connector 10 each of said contacts 14 and 16 is provided with a further contact portion 26 between said connection portion 40 and said jointing fulcrum 30. In the connector 10 angle of said cam portion 54 starting from 10° is varied in increments of 5° for 10 to 20 contacts.

As can be seen from the above description, the cam structure according to the invention and the connector using the cam structure can bring about the following functions and effects.

(1) In the cam structure pivotally moving between electronic parts to act on the other parts, upon pivotal movement, the action on said other parts is varied by partly modifying a cam shape of said cam structure. Therefore, the timing at which the cam contacts the other parts can be easily shifted.

(2) In the cam structure pivotally moving in a connector 10 to bring contacts 14 and 16 into contact with a connecting object inserted in said connector 10,contact pressure of said contacts 14 and 16 is controlled by partly modifying a cam shape of said cam structure. Consequently, the contacting timing for the contacts can be easily shifted.

(3) The connector 10 detachably fitting with a connecting object, includes a required number of contacts 14 and 16 each having a contact portion 26 adapted to contact said connecting object, a housing 12 holding and fixing said contacts 14 and 16 therein and having a fitting opening 20 for inserting said connecting object thereinto, and a pivoting member 18 having a cam portion 54 which urges said contacts 14 and 16, wherein said contacts 14 and 16 each have at one end the contact portion 26 adapted to contact said connecting object and at the other end a pressure receiving portion 32 adapted to be urged by said cam portion 54 of said pivoting member 18, and wherein said pivoting member 18 is pivotally mounted on said housing 12 so as to urge the pressure receiving portions 32 of said contacts 14 and 16 upon pivotal movement of said pivoting member 18, while contact pressure of said contacts 14 and 16 against said connecting object is controlled by partly modifying a cam shape of said cam portion 54. Accordingly, the contacting timing for the contacts can be easily shifted, and the force by which the cam is rotated can be easily changed.

(4) In the connector 10 said contacts 14 and 16 each comprise a first piece 22 including at one end the contact portion 26 adapted to contact said connecting object and at the other end the pressure receiving portion 32 to be urged by the cam portion 54 of said pivoting member 18, a second piece 24 including at one end an extension portion 36 having a further contact portion 26 or a fixed portion 38 and at the other end a connection portion 40 to be connected to a substrate, and a jointing fulcrum 30 for connecting said first and second pieces 22, 24, and said housing 12 having a ceiling portion 50 for covering the contact portions 26 of said contacts 14 and 16, while said pivoting member 18 comprises an actuating portion 56 for pivotally moving the pivoting member 18, the cam portion 54 having longitudinally continuous cam parts, and anchoring holes 58 provided independently from one another into which said pressure receiving portions 32 can be inserted, said pivoting member 18 being pivotally mounted on said housing 12 so that said cam portion 54 is pivotally movable between the connection portions 40 and the pressure receiving portions 32 of said contacts 14 and 16. Consequently, the contacting timing for the contacts can be easily shifted, and the force by which the cam is rotated can be easily changed. A reduced overall height and miniaturization of the connector can also be accomplished.

(5) In the connector said contacts 14 and 16 each comprise a first piece 22 including at one end the contact portion 26 adapted to contact said connecting object and at the other end the pressure receiving portion 32 to be urged by the cam portion 54 of said pivoting member 18, a second piece 24 including at one end a connection portion 40 to be connected to a substrate and at the other end an extension portion 36, and a jointing fulcrum 30 for connecting said first and second pieces 22, 24, and said housing 12 having a ceiling portion 50 for covering the contact portions 26 of said contacts 14 and 16, while said pivoting member 18 comprises an actuating portion 56 for pivotally moving the pivoting member, the cam portion 54 having longitudinally continuous cam parts, and anchoring holes 58 provided independently from one another into which said pressure receiving portions 32 can be inserted, said pivoting member 18 being pivotally mounted on said housing 12 so that said cam portion 54 is pivotally movable between the connection portions 40 and the pressure receiving portions 32 of said contacts 14 and 16. Accordingly, the contacting timing for the contacts can be easily shifted, and the force by which the cam is rotated can be easily changed. A reduced overall height and miniaturization of the connector can also be accomplished.

(6) In the connector 10 each of said contacts 14 and 16 is provided with a further contact portion 26 between said connection portion 40 and said jointing fulcrum 30. Accordingly, the contacting timing for the contacts can be easily shifted, and the force by which the cam is rotated can be easily changed. A reduced overall height and miniaturization of the connector can also be accomplished.

(7) In the connector 10 recited in claim 7, angle of said cam portion 54 starting from 10° is varied in increments of 5° for 10 to 20 contacts. Therefore, the force by which the cam is rotated can be distributed or dispersed so that the cam can readily be rotated (pivotally rotated), thereby achieving stable electrical connection. These values such as angles and number of contacts are obtained by reasonable analysis as described later in the descriptions of the embodiments, but are not mere design matters.

The invention will be more fully understood by referring to the following detailed specification and claims taken in connection with the appended drawings.

DESCRIPTION OF THE PREFERRED EMBODIMENTS

Figure 1A:
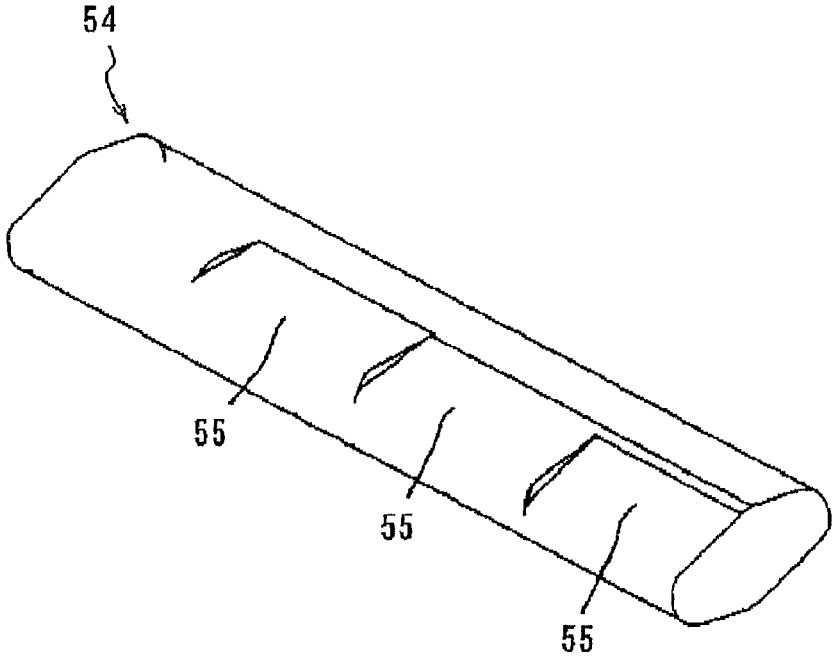
FIG. 1A is a perspective view illustrating a cam shape for mitigating turning force according to the invention.
Figure 1B:
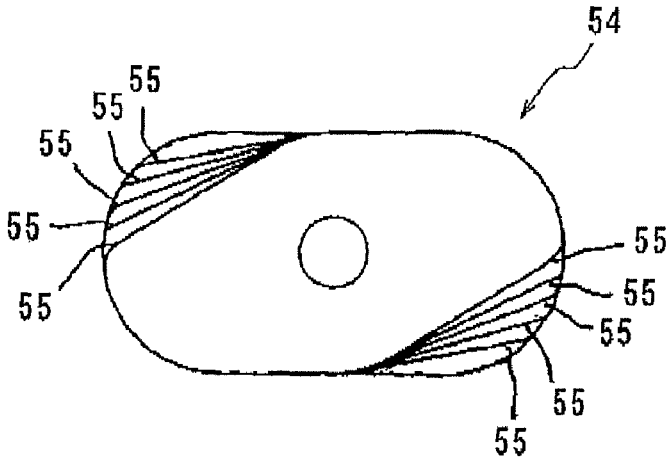
FIG. 1B is a side view illustrating the cam shape for mitigating turning force according to the invention.
Figure 2A:
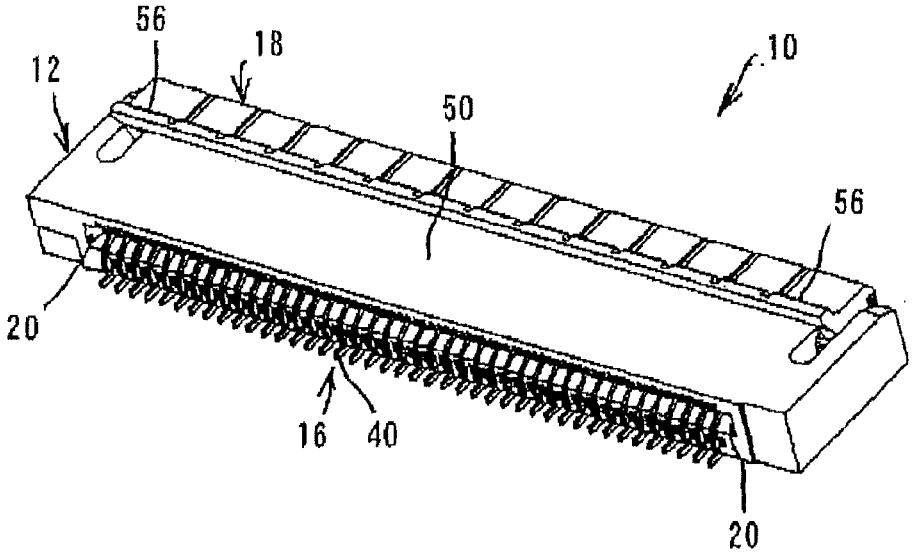
FIG. 2A is a perspective view of the connector according to the invention with the pivoting member opened, viewed from the side inserting a flexible printed circuit board.
Figure 2B:
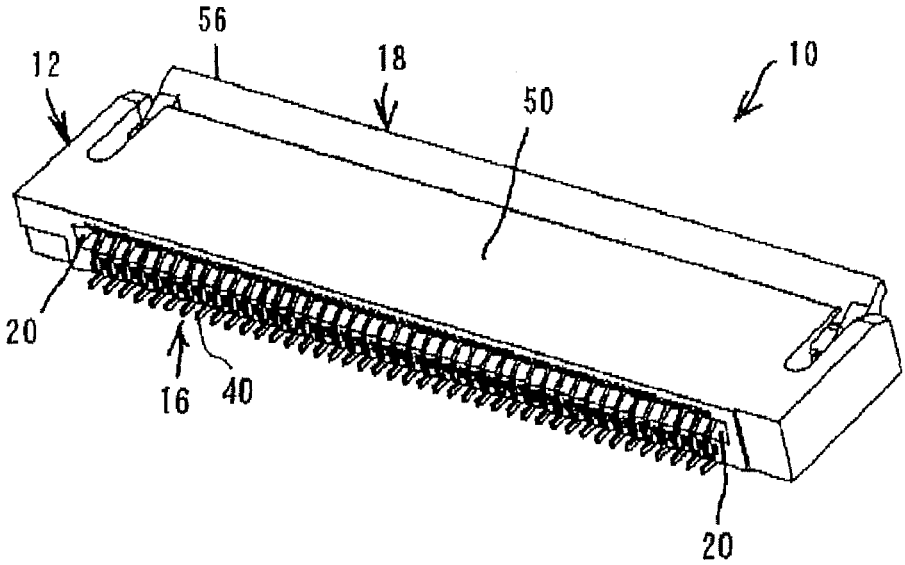
FIG. 2B is a perspective view of the connector shown in FIG. 2A with the pivoting member closed.
Figure 3:
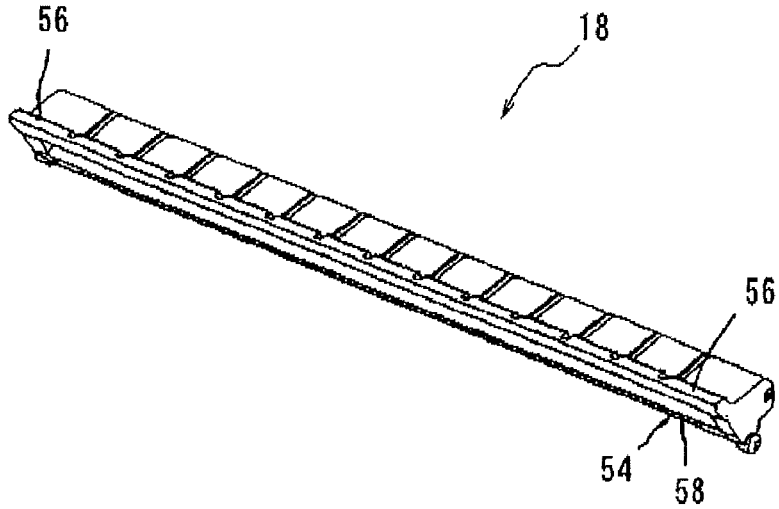
FIG. 3 is a perspective view of the pivoting member.
Figure 4:
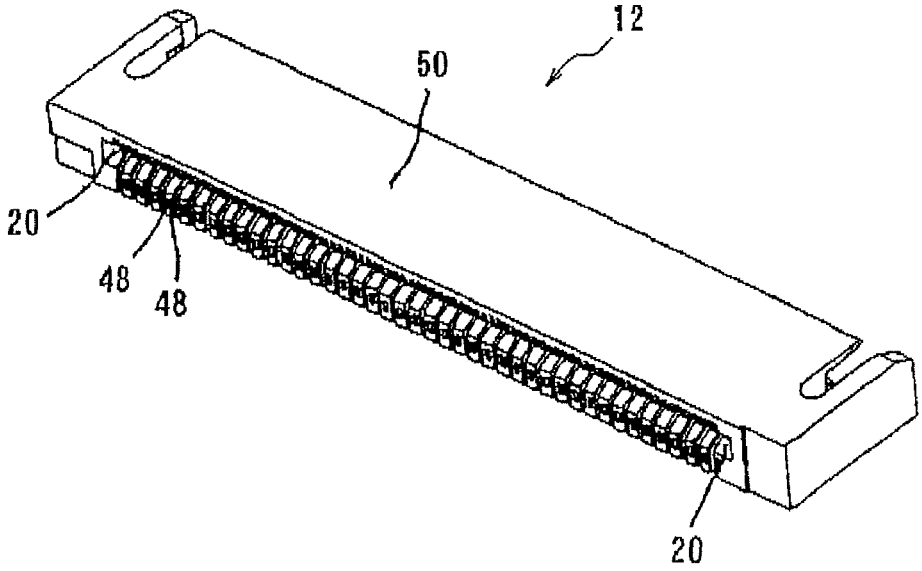
FIG. 4 is a perspective view of a housing of the connector according to the invention.
Figure 5A:
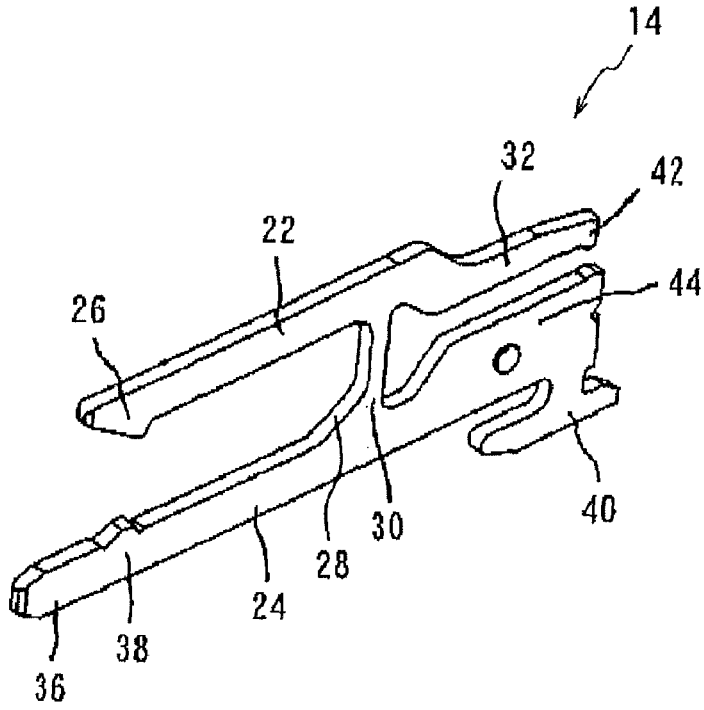
FIG. 5A is a perspective view of a contact of one kind used in the connector according to the invention.
Figure 5B:
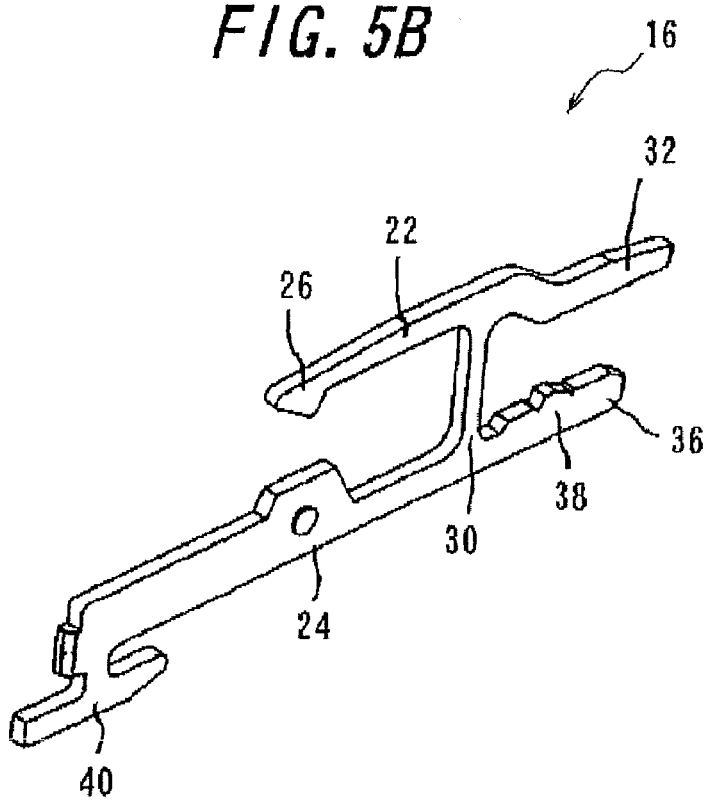
FIG. 5B is a perspective view of a contact of the other kind used in the connector according to the invention.
Figure 6A:
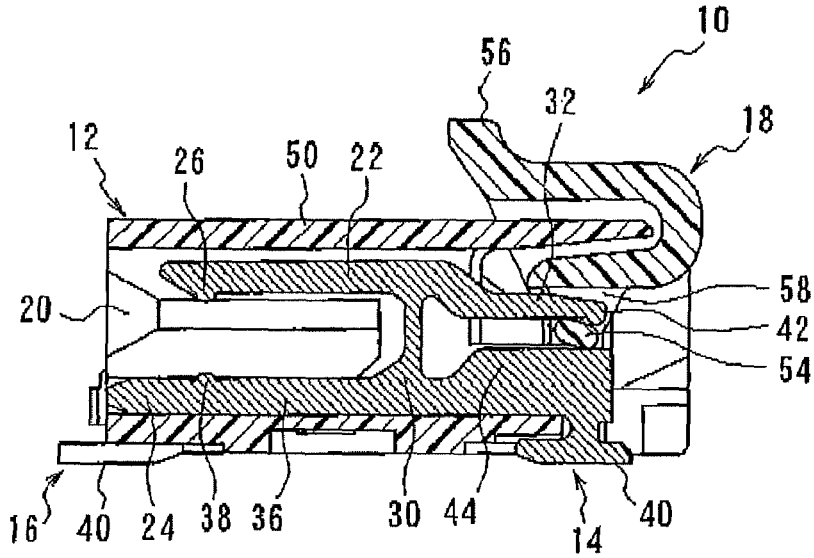
FIG. 6A is a sectional view of the connector according to the invention with the pivoting member opened, taken along one contact of the one kind.
Figure 6B:
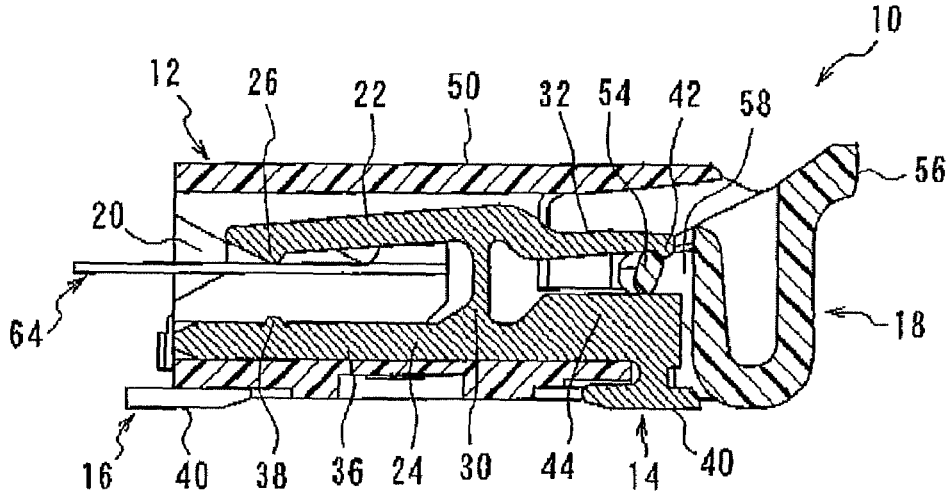
FIG. 6B is a sectional view of the connector according to the invention with the pivoting member closed, taken along one contact of the one kind.
Figure 7A:
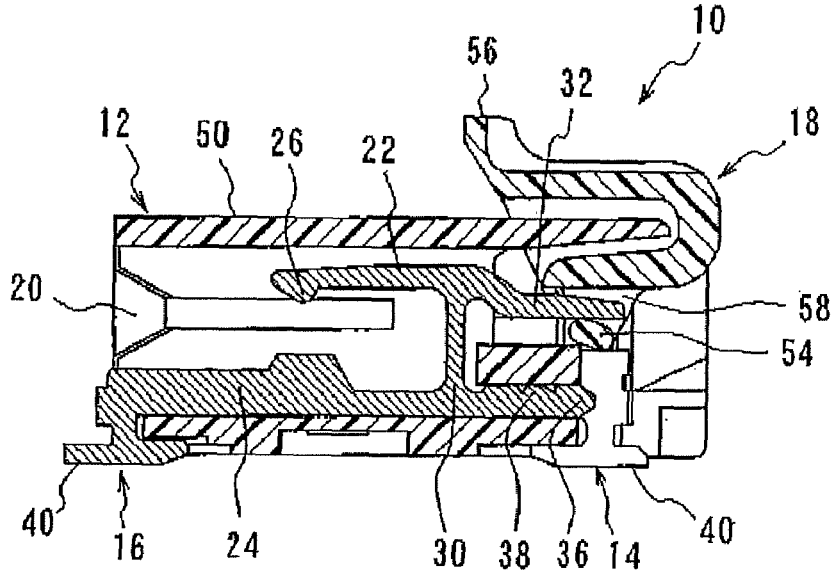
FIG. 7A is a sectional view of the connector according to the invention with the pivoting member opened, taken along one contact of the other kind.
Figure 7B:
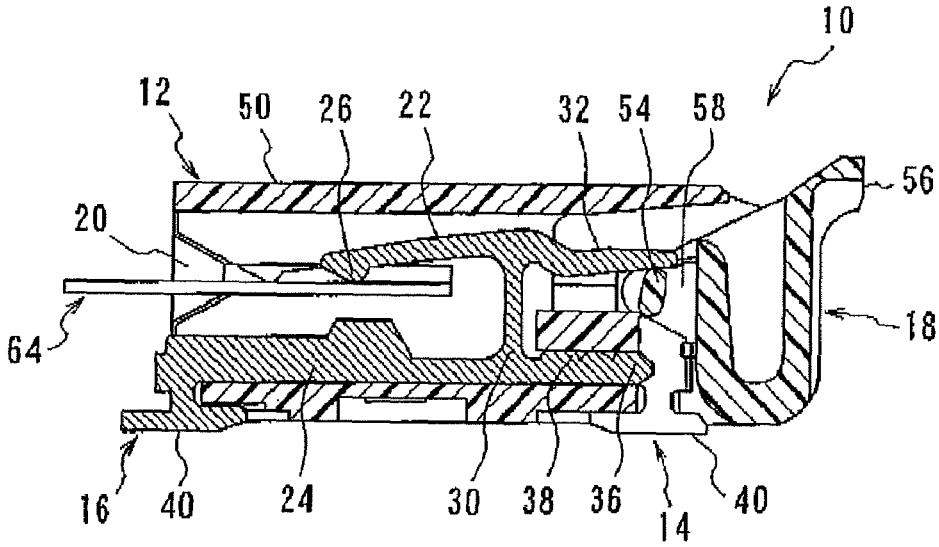
FIG. 7B is a sectional view of the connector according to the invention with the pivoting member closed, taken along one contact of the other kind.
Figure 8A:
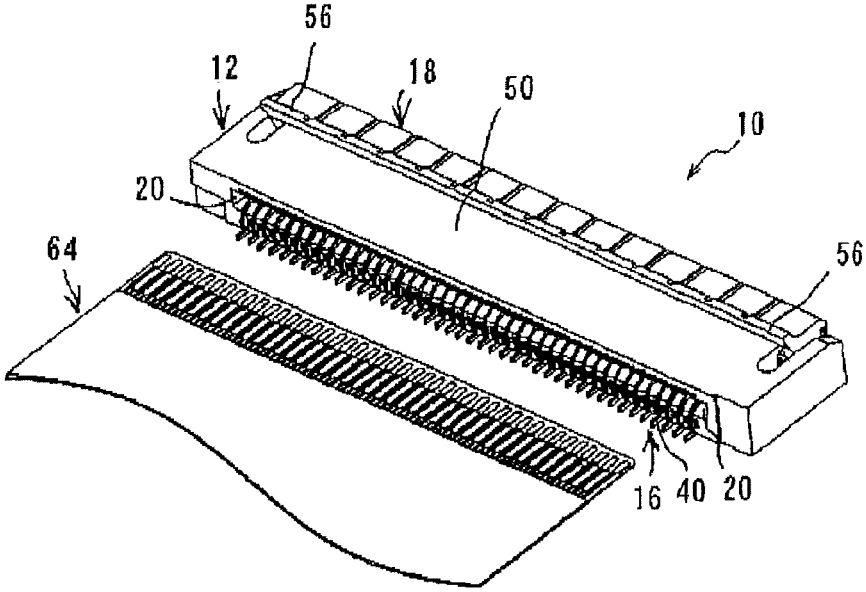
FIG. 8A is the connector according to the invention and a flexible printed circuit board before being inserted into the connector.
Figure 8B:
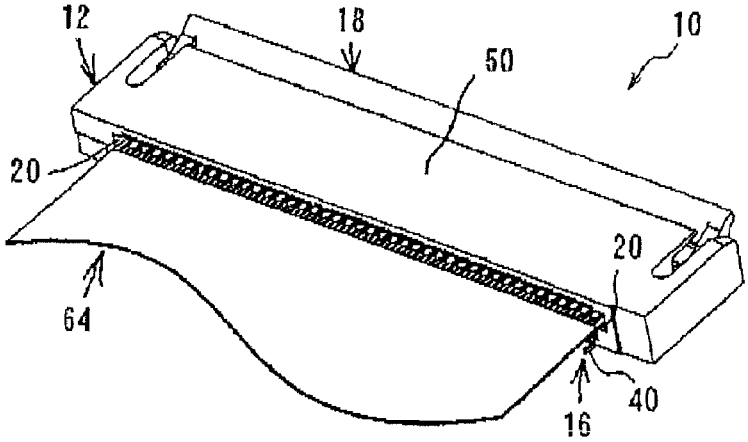
FIG. 8B is the connector according to the invention with the flexible printed circuit board inserted.
Figure 9:
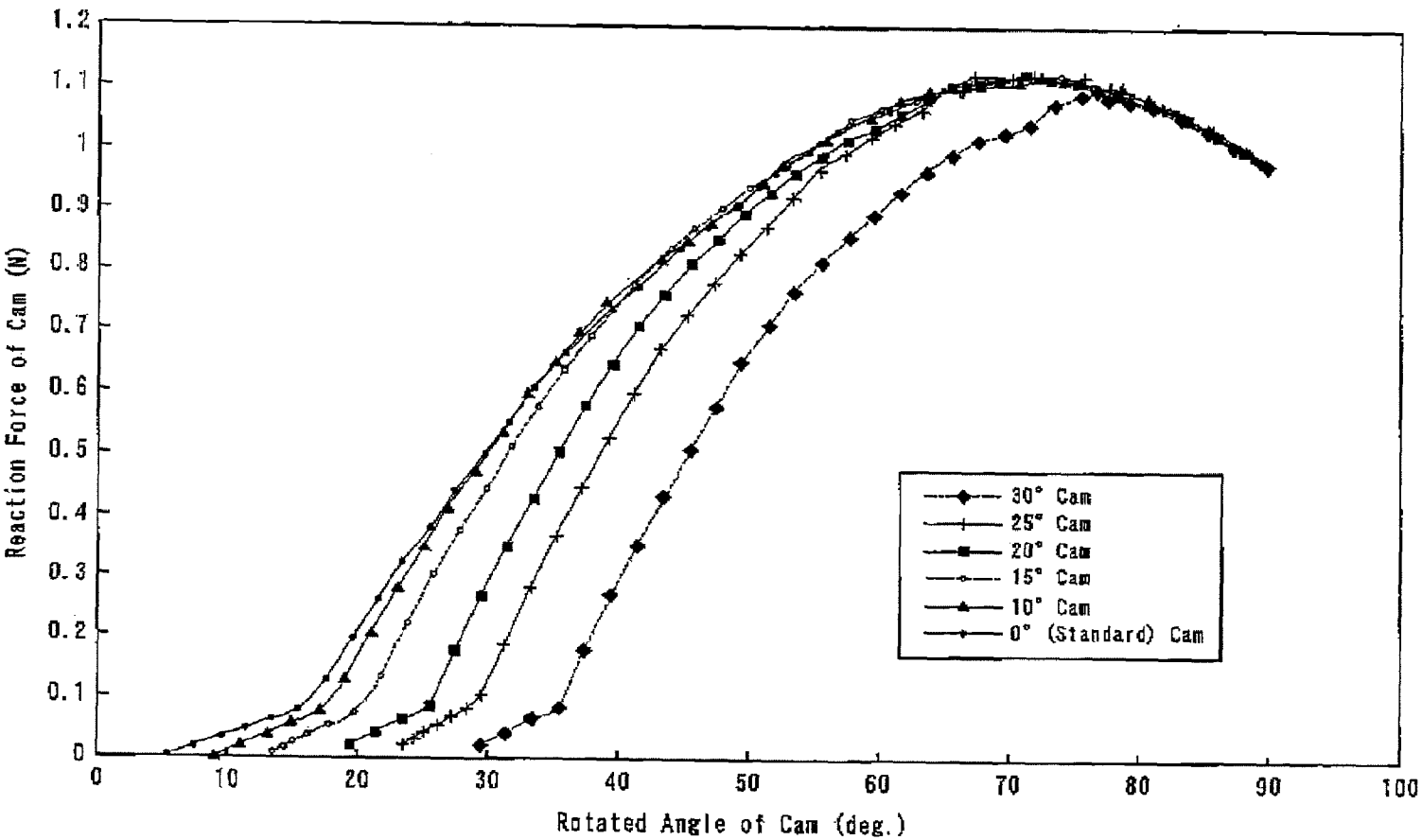
FIG. 9 is a graph illustrating analysis results of reaction forces of a cam whose angles are changed.

One embodiment of a connector using a cam structure according to the invention will be explained with reference to FIGS. 1 to 9. FIG. 1A is a perspective view illustrating a shape of the cam for mitigating turning force, and FIG. 1B is a side view of the cam shown in FIG. 1A. FIG. 2A is a perspective view of the connector with a pivoting member opened, viewed from the inserting side of a flexible printed circuit board, while FIG. 2B is a perspective view of the connector of the FIG. 2A with the pivoting member closed. FIG. 3 is a perspective view of the pivoting member. FIG. 4 is a perspective view of the housing of the connector. FIG. 5A is a perspective view of a contact of one kind, and FIG. 5B is a perspective view of a contact of the other kind. FIG. 6A is a sectional view of the connector taken along a contact of the one kind with the pivoting member opened, while FIG. 6B is a sectional view of the connector shown in FIG. 6A with the pivoting member closed. FIG. 7A is a sectional view of the connector taken along a contact of the other kind with the pivoting member opened, while FIG. 7B is a sectional view of the connector shown in FIG. 7A with the pivoting member closed. FIG. 8A is a perspective view of the connector and a flexible printed circuit board before being inserted, and FIG. 8B is a perspective view similar to FIG. 8A but with the board inserted. FIG. 9 is a graph illustrating analysis results of reaction forces of a cam whose angles are changed.

The connector of the illustrated embodiment mainly comprises a housing 12, a pivoting member 18 and contacts 14 and 16. With the connector 10, the contacts 14 and 16 of the two kinds are inserted into the housing 12 alternately in different or opposite directions so that the contacts 14 and 16 are alternately staggered relative to each other, thereby achieving a narrower pitch and a reduced overall height of the connector.

First, the cam structure of the subject feature of the invention will be explained together with analysis results according to ANSYS with reference to FIGS. 1A and 1B. FIG. 9 is a graph illustrating the analysis results of reaction forces of a cam whose angles are changed as 0° (standard surface), 10°, 15°, 20°, 25° and 30° for the contacts. As can be seen in the graph shown in FIG. 9, starting points of respective curves to which reaction forces are initially applied are generally shifted, but terminal points of the respective curves substantially coincide with one another, and the reaction forces of the cam at the terminal points become substantially 1.1N per one contact. From these results, it will be understood that the timing of the reaction forces can be delayed by changing the angles of the cam and that when the number of contacts is n, the total of the reaction forces amounts to n times 1.1N ($n \times 1.1N$). This value is preferably of the order of 10N to 20N in order to facilitate manual rotation of the cam or the pivoting member. In the illustrated embodiment, starting from 10° the angle is increased in increments of 5° for 15 contacts as shown in FIG. 1B. In other words, the number of the contacts is 80, and the cam part of angle 10° is for the first to the fifteenth contacts, the cam part of angle 15° for the sixteenth to thirtieth contacts, the cam part of angle 20° for the thirty-first to the forty-fifth contacts, the cam part of angle 25° for the forty-sixth to the sixtieth contacts, the cam part of angle 30° for the sixty-first to the seventy-fifth contacts, and the cam part of standard surface (0°) for the seventy-sixth to the eightieth contacts. Continuing with the description of the changing the angles for the contacts referring to the perspective view of FIG. 1A, the standard surface (0°) of the cam portion 54 is shown at its left end, and the cam parts of 10°, 20°, and 30° are located side by side in this order toward its right end. Reference numerals 55 in FIG. 1A denote such cam parts of various angles.

The contacts 14 and 16 of the two kinds will be explained with reference to FIGS. 5A and 5B. The contacts 14 and 16 of the two kinds are made of a metal and formed by means of the press-working of the known technique. Preferred metals from which to form the contacts 14 and 16 include brass, beryllium copper, phosphor bronze and the like which comply with the requirements such as springiness, electric conductivity and the like.

First, the contact 14 of the one kind shown in FIG. 5A will be explained. Said contact 14 of the one kind is of substantially an H-shape as shown in FIG. 5A and at least comprises a contact portion 26 (at the upper part viewed in FIG. 5A) adapted to contact said flexible printed circuit board 64, a connection portion 40 to be connected to a substrate or the like, a fixed portion 38 to be fixed to said housing 12, a jointing fulcrum 30, and a pressure receiving portion 32 adapted to be urged by the pivoting member 18. Said contact portion 26 and said pressure receiving portion 32 are provided at both the ends of a first piece 22 substantially in the form of a crank. Said pressure receiving portion 32 is provided at its end with a projection 42 inwardly extending. The contact 14 comprises a second piece 24 including on the side of one end an extension portion 36 having the fixed portion 38 to be inserted into said housing 12, and on the side of the other end the connection portion 40 to be connected to the substrate. Said first piece 22 and said second piece 24 are connected to each other substantially at their mid portions by the jointing fulcrum 30. Said contact portion 26, said jointing fulcrum 30 and said connection portion 40 are arranged substantially in the form of a crank. Said connection portion 40 is provided with a protrusion base 44 extending toward said pressure receiving portion 32 so that a cam portion 54 of said pivoting member 18 can be pivotally rotated between said pressure receiving portions 32 and said protrusion bases 44 of the contacts 14. In the illustrated embodiment, said contact 14 is provided in the proximity of the jointing fulcrum 30 with an inclined portion 28 facing to the fitting opening 20 of the housing 12 for contributing to a reduced overall height of the connector. Moreover, said protrusion base 44 serves to adjust the distance between the pressure receiving portion 32 and the connection portion 40 for achieving the stable pivotal movement of the cam portion 54 of said pivoting member 18. The extending height of the protrusion base 44 may be suitably designed in consideration of such a function of the protrusion base 44.

The location of said connection portion 40 may be suitably designed in consideration of positions of lands and patterns of a substrate, narrow spaces and the like. In other words, said connection portion 40 may be provided on the side facing to said contact portion 26 or to said pressure receiving portion 32 depending on requirements and specifications of customers. Moreover, said connection portions 40 of said contacts may be arranged to be staggered relative to each other depending on positions of lands of a substrate. In said contact 14 of the one kind, said connection portion 40 is provided in the position facing to said pressure receiving portion 32. Said contact portion 26 is in the form of a protrusion for the purpose of facilitating the contact with the flexible printed circuit board 64. Although said connection portions 40 are of a surface mounting type (SMT) in the illustrated embodiment as shown in FIG. 5A, it is to be understood that they may be of a dip type. A further contact portion 26 may be provided on the position facing to said first mentioned contact portion 26 so that a flexible printed circuit board 64 is embraced by the two opposite contact portions 26 depending upon specifications of said flexible printed circuit board 64. In the illustrated embodiment, furthermore, said contact 14 of the one kind is provided with the extension portion 36 extending from said jointing fulcrum 30 in a manner facing to said contact portion 26, and the extension portion 36 is provided thereon with the fixed portion 38 for fixing the contact 14 to said housing 12. The size and shape of said fixed portion 38 may be suitably designed in consideration of the holding force for the contact 14, the strength of said housing 12 and the like.

Said jointing fulcrum 30 and said pressure receiving portion 32 will perform the following functions upon insertion of said flexible printed circuit board 64 into the housing 12. After said flexible printed circuit board 64 has been inserted into the fitting opening 20 of said housing 12, when the cam portion 54 of said pivoting member 18 is pivotally moved between the pressure receiving portions 32 and the protrusion bases 44 of the connection portions 40 of said contacts 14, said pressure receiving portions 32 are raised by the cam portion 54 so that the upper ends of the jointing fulcrums 30 are tilted toward said contact portions 26 about the lower ends (viewed in FIG. 5A) of the jointing fulcrums 30, thereby causing said contact portions 26 to be urged or pressed against said flexible printed circuit board 64. Sizes and shapes of said jointing fulcrums 30 and said pressure receiving portions 32 may be suitably designed so as to be able to perform such functions described above. The pressure receiving portion 32 of said contact 14 is preferably provided at its distal end with the projection 42 as described above which is brought into engagement with one of anchoring holes 58 of said pivoting member 18 when the cam portion 54 of the pivoting member 18 is pivotally moved between the pressure receiving portion 32 and the protrusion base 44 of the connection portion 40 of the contact 14. The engagement of the projections 42 with the anchoring holes 58 of said pivoting member 18 will resist to strong reaction force against the pivotal movement of the pivoting member 18. The size of said projection 42 may be any one insofar as it serves to achieve the purpose described above, and may be suitably designed so as to engage the anchoring hole of the pivoting member 18.

The contacts 16 of the other kind will then be explained. Differences from the contacts 14 already described will only be explained. As is also the case in said contact 14 of the one kind, said contact 16 of the other kind is of substantially an H-shape as shown in FIG. 5B. The contact 16 mainly comprises a contact portion 26 (at the upper part viewed in FIG. 5B) adapted to contact the flexible printed circuit board 64, a connection portion 40 to be connected to the substrate, a fixed portion 38 to be fixed to the housing 12, a jointing fulcrum 30, and a pressure receiving portion 32 to be urged by said pivoting member 18. Said contact portion 26, said jointing fulcrum 30 and said connection portion 40 are arranged substantially in a U-shape. While said connection portions 40 are of a surface mounting type (SMT) similar to the contact 14 of the one kind, it will be apparent that they may be of a dip type.

The differences between said contacts 14 and 16 of the two kinds lie in the fact that the connection portions 40 and the extension portions 36 are reversely positioned to each other in the two kinds, aside from some geometric differences. In other words, with said contact 14 of the one kind, said connection portion 40 is located on the side facing to said pressure receiving portion 32 and said extension portion 36 is located on the side facing to said contact portion 26. In contrast herewith, with said contact 16 of the other kind, said connection portion 40 is located on the side facing to said contact portion 26 and said extension portion 36 is located on the side facing to said pressure receiving portion 32. The extension portion 36 of said contacts 16 of the other kind is provided with the fixed portion 38 for fixing the contact 16 to said housing 12.

The pivoting member 18 will then be explained. The pivoting member 18 is formed from an electrically insulating plastic material by means of the injection molding of the known technique. The materials for the pivoting member may be selected in consideration of dimensional stability, workability, manufacturing cost and the like and generally include polybutylene terephthalate (PBT), polyamide (66PA or 46PA), liquid crystal polymer (LCP), polycarbonate (PC) and the like and combination thereof.

Said pivoting member 18 mainly comprises axles for pivotally mounting the pivoting member 18 on the housing 12, the cam portion 54 for urging or pressing the pressure receiving portions 32 of said contacts 14 and 16, the anchoring holes 58 adapted to engage the projections 42 of said contacts 14 and 16, respectively, and an actuating portion 56. In the illustrated embodiment, said pivoting member 18 has a substantially U-shaped cross-section. Said axles are a fulcrum for the pivotal movement of the pivoting member 18 and suitably fitted in bearings or holes at the longitudinal ends of the housing 12 to allow the pivoting member to be pivotally moved. There are clearances in the bearings of the housing 12 in relation to the axles of the pivoting member 18 in order to move the axis 72 of rotation of its cam portion 54 being pivotally moved. Moreover, the pivoting member 18 is provided at its longitudinal ends with locking portions adapted to engage the housing 12 for the purpose of preventing the pivoting member 18 from being raised (in the direction of height viewed in the drawings) when the pressure receiving portions 32 of said contacts 14 and 16 are urged or pressed. The shape and size of the locking portions may be arbitrary insofar as they can engage the housing 12 and may be suitably designed in consideration of their function described above, the size and strength of the connector, and the like.

Said cam portion 54 of said pivoting member 18 serves to urge or press said pressure receiving portions 32 of the contacts 14 and 16, and is preferably of an elongated shape and has a substantially elliptical cross-section in the illustrated embodiment. With such an elliptical cross-section of the cam portion 54, upon rotation of the cam portion 54 between the pressure receiving portions 32 and the protrusion bases 44 of the connection portions 40 of the contacts 14 and 16, the pressure receiving portions 32 of the contacts 14 and 16 are raised with the aid of the variation in height of contact points caused by the cross-section of the cam portion 54, thereby urging the contact portions 26 of the contacts 14 and 16 against the flexible printed circuit board 64. The shape of the cam portion 54 may be any shape so long as the following functions can be achieved. That is, the cam portion 54 can be rotated between the pressure receiving portions 32 and the protrusion bases 44 of the connection portions 40 of the contacts 14 and 16, and the pressure receiving portions 32 of the contacts 14 and 16 can be raised with the aid of the variation in height of contact points between the cam portion 54 and the pressure receiving portions 32 caused by the variation in size such as major and minor axes of an ellipse. In addition, the turning force of said pivoting member 18 can be mitigated, and timing can be shifted, by means of the cam angles of the cam portion 54 which are varied for the fifteen contacts as shown in FIG. 1A. The shape and size of said cam portion 54 may be suitably designed in consideration of these functions. In the illustrated embodiment having eighty contacts, starting from the angle 10°, the angle is varied in increments of 5° for the fifteen contacts. In more detail, the cam portion 54 has the angle 10° for the first to the fifteenth contacts, the angle 15° for the sixteenth to the thirtieth contacts, the angle 20° for the thirty-first to the forty-fifth contacts, the angle 25° for the forty-sixth to the sixtieth contacts, the angle 30° for the sixty-first to the seventy-fifth contacts, and 0° (the standard surface) for the seventy-sixth to the eightieth contacts.

Moreover, said pivoting member 18 is provided with the actuating portion 56 for improving its operationality. The particular feature of the pivoting member is that the cam portion 54 is pivotally moved between the pressure receiving portions 32 and the protrusion bases 44 of said contacts 14 of the one kind so that the pressure receiving portions 32 of said contacts 14 and 16 of both the kind are raised, thereby bringing the contact portions 26 of said contacts 14 and 16 of both the kinds into contact with the flexible printed circuit board 64.

Said pivoting member 18 is formed with the anchoring holes 58 provided independently from one another, into which the projections 42 of said contacts 14 and 16 to resist to the strong reaction forces against the pivotal movement of the pivoting member 18. By providing the anchoring holes 58 independently from one another, the strength of the pivoting member 18 can be improved to prevent its deformation upon its pivotal movement.

Said pivoting member 18 is pivotally mounted on said housing 12 on the side opposite from the fitting opening 20, that is, on the side of the connection portions of the contacts 14 of the one kind. After the contacts 14 and 16 of both the kinds have been fixed in said housing 12, said pivoting member 18 is inserted from the side of the connection portions 40 of the contacts 14 of the one kind and held.

The housing 12 will then be explained. The housing 12 is formed from an electrically insulating plastic material by means of the injection molding of the known technique. The materials for the housing may be selected in consideration of dimensional stability, workability, manufacturing cost and the like and generally include polybutylene terephthalate (PBT), polyamide (66PA or 46PA), liquid crystal polymer (LCP), polycarbonate (PC) and the like and combination thereof.

Said housing 12 is formed with inserting grooves 48 into which a required number of the contacts 14 and 16 are fitted and fixed by press-fitting, hooking (lancing), welding and the like. Moreover, said housing 12 is provided with the fitting opening 20 for inserting said flexible printed circuit board 64 thereinto. The size of said fitting opening 20 may be suitably designed such that said flexible printed circuit board 64 can be inserted into the opening 20 and can be brought into contact with said contacts 14 and 16 by means of the pivoting member 18 after the board 64 has been inserted. Said housing 12 is provided at both the longitudinal ends with the bearings into which the axles of said pivoting member 18 are fitted to be pivotally moved. As described above, the bearings have clearances in relation to said axles of the pivoting member so that the cam portion 54 of said pivoting member 18 can be compactly rotated. The shape and size of the bearings may be arbitrary so long as the pivoting member 18 can be pivotally moved and its cam portion 54 can be compactly rotated, and may be suitably designed in consideration of their functions, strength and size of the housing 12, and the like.

Said housing 12 is provided with a ceiling portion 50 for covering the contact portions 26 of said contacts 14 and 16 for the purpose of improving the dust-proof property for said contacts 14 and 16. The size and shape of the ceiling portion may be suitably designed in consideration of its function, the strength of said housing 12, pivotal movement capability and strength of said pivoting member 18, and the like. Thicknesses of said housing 12 are made as thin as possible in order to achieve the reduced overall height of the connector.

Examples of applications of the invention include connectors using a flexible printed circuit board for use in electric and electronic appliances such as flat-screen televisions, rear projection screens and the like, and more particularly cam structures with variant cam shapes being capable of varying forces and actions to be applied to mating objects.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector detachably fitting with a connecting object, including a required number of contacts each having a contact portion adapted to contact said connecting object, a housing holding and fixing said contacts therein and having a fining opening for inserting said connecting object thereinto, and a pivoting member having a cam portion which urges said contacts, wherein said contacts each have at one end said contact portion adapted to contact said connecting object and at the other end a pressure receiving portion adapted to be urged by said cam portion of said pivoting member, and wherein said pivoting member is pivotally mounted on said housing so as to urge the pressure receiving portions of said contacts upon pivotal movement of said pivoting member, wherein said cam of the pivoting member is shaped to have a plurality of elliptical cross-sections that are stepwisely shifted so that the contacts pressed by the cam are divided into plural groups to decrease the pivotal power.

2. The connector as set forth in claim 1, wherein said contacts each comprise a first piece including at one end the contact portion adapted to contact said connecting object and at the other end the pressure receiving portion to be urged by the cam portion of said pivoting member, a second piece including at one end an extension portion having a further contact portion or a fixed portion and at the other end a connection portion to be connected to a substrate, and a jointing fulcrum for connecting said first and second pieces, and wherein said housing having a ceiling portion for covering the contact portions of said contacts, and said pivoting member comprises an actuating portion for pivotally moving the pivoting member, the cam portion having longitudinally continuous cam parts, and anchoring holes provided independently from one another into which said pressure receiving portions can be inserted, said pivoting member being pivotally mounted on said housing so that said cam portion is pivotally movable between the connection portions and the pressure receiving portions of said contacts.

3. The connector as set forth in claim 1, wherein said contacts each comprise a first piece including at one end the contact portion adapted to contact said connecting object and at the other end the pressure receiving portion to be urged by the cam portion of said pivoting member, a second piece including at one end a connection portion to be connected to a substrate and at the other end an extension portion, and a jointing fulcrum for connecting said first and second pieces, and wherein said housing having a ceiling portion for covering the contact portions of said contacts, and said pivoting member comprises an actuating portion for pivotally moving the pivoting member, the cam portion having longitudinally continuous cam parts, and anchoring holes provided independently from one another into which said pressure receiving portions can be inserted, said pivoting member being pivotally mounted on said housing so that said cam portion is pivotally movable between the connection portions and the pressure receiving portions of said contacts.

4. The connector as set forth in claim 3 wherein each of said contacts is provided with a further contact portion between said connection portion and said joining fulcrum.

5. The connector as set forth in any one of claims 1 to 4, herein angle of said cam portion starting from 10° is varied in increments of 5° for 10 to 20 contacts.

* * * * *